United States Patent [19]

Kimball, III et al.

[11] 4,166,232

[45] Aug. 28, 1979

[54] FILAMENT LEAD-IN SUPPORT FOR TUNGSTEN HALOGEN CAPSULE FOR HEADLIGHT

[75] Inventors: Stephen F. Kimball, III, Andover; Lewis H. Palmer, III, Marblehead, both of Mass.

[73] Assignee: GTE Sylvania Incorporated, Stamford, Conn.

[21] Appl. No.: 886,252

[22] Filed: Mar. 13, 1978

[51] Int. Cl.[2] ..... H01K 1/42; H01K 9/08

[52] U.S. Cl. ..... 313/316; 313/115; 313/318

[58] Field of Search ..... 313/318, 113, , 315, 313/316

[56] References Cited

U.S. PATENT DOCUMENTS

| | | | |
|---|---|---|---|
| 3,801,178 | 4/1974 | Berge | 313/271 X |
| 3,829,729 | 8/1974 | Westlund et al. | 313/174 |
| 4,088,918 | 5/1978 | Gates et al. | 313/381 X |

*Primary Examiner*—Robert Segal

*Attorney, Agent, or Firm*—James Theodosopoulos

[57] ABSTRACT

In the manufacture of a capsule for a sealed beam lamp or vehicle headlight, two coiled filaments on lead-in wires are supported in a holder with sufficient rigidity to accurately maintain a predetermined spacing between the filaments during a subsequent press sealing operation. The filaments are then inserted into an open-ended glass tube and the open end is press sealed onto the filament lead-in wires at the same time that wire supports are embedded in the press seal. The wire supports are then connected to mounting rods in the finished capsule.

1 Claim, 3 Drawing Figures

FILAMENT LEAD-IN SUPPORT FOR TUNGSTEN HALOGEN CAPSULE FOR HEADLIGHT

BACKGROUND OF THE INVENTION

This invention is concerned with tungsten halogen lamps, often called capsules, for use in vehicle headlights. It is particularly concerned with such capsules containing two filaments, and especially with the manufacture of capsules having simpler construction than those presently commercially available, as exemplified by U.S. Pat. No. 3,801,178.

SUMMARY OF THE INVENTION

Two coiled filaments on lead-in wires are supported in a holder with sufficient rigidity to accurately maintain a predetermined spacing between the filaments during a subsequent press sealing operation. The filaments are then inserted into an open-ended glass tube and the open end is press sealed onto the filament lead-in wires at the same time that wire supports are embedded in the press seal. The wire supports are then connected to mounting rods in the finished capsule.

DESCRIPTION OF PREFERRED EMBODIMENT

Figure 1:
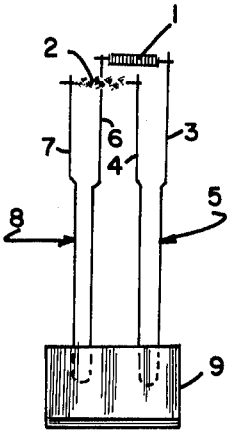
FIG. 1 is a view of the two filaments mounted in a holder.

In one example, as shown in FIG. 1, filaments 1 and 2 were made of coiled tungsten wire. Lead-in wire 3 clampingly supports the right-hand end of filament 1 and lead-in wire 4 similarly supports the right-hand end of filament 2. In a specific example, wires or legs 3 and 4 comprised a single wire 5 bent into a U shape, a shown in FIG. 1, and wire 5 supported corresponding ends of filaments 1 and 2. Wire 5 was made of 13 mil molybdenum wire, had a length of 1.175 inches after it was bent into a U, with wires 3 and 4 being about 57 mils apart at the U end. At the other end, the ends of wires 3 and 4 were displaced predetermined distances from each other for the purpose of proper positioning of filaments 1 and 2. The ends of wires 3 and 4 that were clamped onto filaments 1 and 2 had previously been flattened somewhat to about 8 mils thick for clamping purposes. The left-hand, or corresponding, ends of filaments 1 and 2 were similarly connected to lead-in wires 6 and 7, respectively, which together comprised U shaped wire 8. The U shaped ends of wires 5 and 8 were fairly securely but removably held in a holder 9 the purpose of which was to hold filaments 1 and 2 at their proper spacing until they were secured within glass tubing 10. In one example, holder 9 was a stainless steel block measuring about 15 mm long by 5 mm wide by 6 mm high. The U shaped ends of wires 5 and 8 were inserted into slots in holder 9, each slot being about 17 mils wide by 62 mils long by 188 mils deep. The spacing between filaments 1 and 2 could be adjusted if necessary, while they were held in holder 9.

Figure 2:
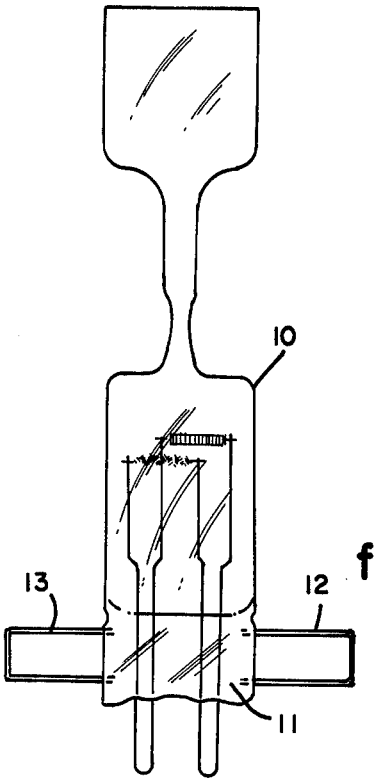
FIG. 2 shows the filaments mounted in a necked down glass tube with wire supports embedded in the press seal thereof.

The next step was to insert filaments 1 and 2, supported in holder 9, into the open end of a glass tubing 10 which had been necked down into the shape shown in FIG. 2, the filaments being disposed substantially transversely to the axis of tubing 10. The end of glass 10 was heated to its working temperature and pressed onto wires 5 and 8 to form press seal 11 while at the same time the ends of U shaped wire supports 12 and 13 were inserted into the longitudinal edges of press seal 11 and were embedded therein. After press seal 11 cooled below its softening point, holder 9 was removed. In one example, glass tubing 10 was 9/16" O.D. and the overall length of necked down glass 10 was about 75 mm. To prevent the need of sealing foils such as molybdenum ribbons in press seal 11, glass tubing 10 was made of hard glass, for example, type 1720 as shown in U.S. Pat. No. 3,829,729 which is incorporated herein by reference instead of quartz which most headlight capsules are presently made of. Elimination of the sealing foils permits the mount assembly to have the desired rigidity throughout press sealing to maintain the proper filament spacing. In one example, wire supports 12 and 13 were made of 30 mil kovar or rodar with the legs being spaced about 4 mm apart. About 1 or 2 mm of each leg was embedded in press seal 11 and the protruding portion was about 9 mm long.

Figure 3:
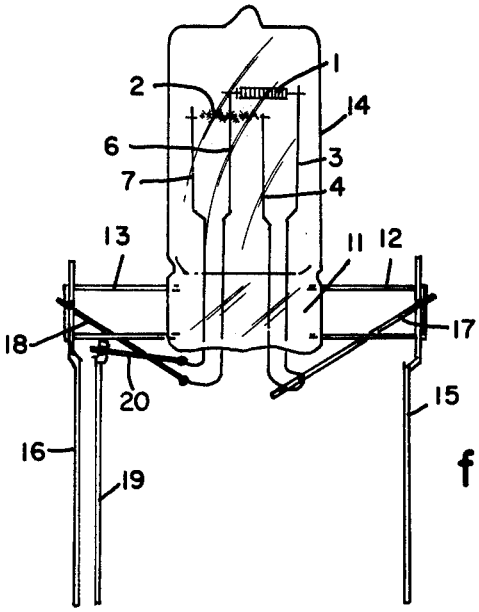
FIG. 3 shows the sealed tungsten-halogen capsule with the lead-in wires and wire supports connected to mounting rods.

Next, glass tubing 10 was exhausted, filled with a gas including halogen and sealed to form glass bottle or capsule 14 as shown in FIG. 3. In one example, the length of bottle 14 including press seal 11 was 30 mm; press seal 11 was about 10 mm long. Next, mounting rods 15 and 16 were securely attached to wire supports 12 and 13. In one example, each mounting rod was made of 70 mil nickel and was welded to the wire support at two points. Then, the end of wire 5 was electrically connected to rod 15 by means of, for example, connecting wire 17, thereby placing the right-hand ends of filaments 1 and 2 in electrical connection with rod 15. The U shaped end of wire 8 was cut off, thereby separating lead-in wires 6 and 7, and lead-in wire 6 was electrically connected to rod 16 by means of, for example, connecting wire 18. The end of wire 7 was electrically connected to another rod 19 by means of connecting wire 20. When mounted in a headlight reflector, as disclosed for example in copending application Ser. No. 883,863 filed on Mar. 6, 1978, rods 15 and 16 are the support rods for capsule 14. Rods 15 and 19 are the electrical feeds for filament 2; rods 15 and 16 are the electrical feeds for filament 1.

We claim:

1. A tungsten-halogen capsule assembly for a headlight comprising: two coiled filaments disposed in a glass capsule substantially transversely to the capsule axis, the glass capsule having a press seal at one end thereof with wire supports embedded in the longitudinal edges of the press seal and extending therefrom; one corresponding pair of the filament ends being supported by a U shaped wire embedded in the press seal and extending exteriorly of the capsule, the U shaped wire being electrically connected to a mounting rod which is fastened to one of the wire supports; the other ends of the filaments being each supported by a separate lead-in wire, one of the separate lead-in wires being electrically connected to another mounting rod which is fastened to another of the wire supports and the other separate lead-in wire being electrically connected to a rod which is unconnected to any of the wire supports.

* * * * *